US007077698B2

(12) United States Patent
Matthys et al.

(10) Patent No.: US 7,077,698 B2
(45) Date of Patent: Jul. 18, 2006

(54) SECURING DEVICE FOR ELECTRICAL CONNECTORS AND APPLICATION THEREOF

(75) Inventors: Geert Matthys, Broechem (BE); Geert Van Den Bossche, Lokeren (BE); Tim Withofs, Brasschaat (BE)

(73) Assignee: Thomson Licensing, Boulogne-Billencourt (FR)

( * ) Notice: Subject to any disclaimer, the term of this patent is extended or adjusted under 35 U.S.C. 154(b) by 0 days.

(21) Appl. No.: 11/074,954

(22) Filed: Mar. 8, 2005

(65) Prior Publication Data

US 2005/0202719 A1 Sep. 15, 2005

(30) Foreign Application Priority Data

Mar. 12, 2004 (EP) ..... 04447063

(51) Int. Cl.
*H01R 13/60* (2006.01)

(52) U.S. Cl. ..... 439/557; 439/369

(58) Field of Classification Search ..... 439/557, 439/553, 567, 563, 544, 79, 562, 558, 554, 439/555, 358, 295, 369
See application file for complete search history.

(56) References Cited

U.S. PATENT DOCUMENTS

| | | | | |
|---|---|---|---|---|
| 3,337,836 | A * | 8/1967 | Churla, Jr. | 439/295 |
| 3,394,338 | A | 7/1968 | Hickes et al. | 339/111 |
| 3,523,269 | A * | 8/1970 | Bissland et al. | 439/358 |
| 5,279,507 | A | 1/1994 | Kameyama | 439/552 |
| 5,525,074 | A | 6/1996 | Tsuji et al. | 439/555 |
| 5,895,289 | A * | 4/1999 | Smith | 439/553 |
| 6,368,152 | B1 * | 4/2002 | Takeguchi | 439/557 |

* cited by examiner

*Primary Examiner*—Truc T. Nguyen
*Assistant Examiner*—Edwin A. Leon
(74) *Attorney, Agent, or Firm*—Joseph Lake; Harvey D. Fried; Patricia Verlangieri

(57) ABSTRACT

A securing device for maintaining a first electrical connector in contact with a second electrical connector through at least one window of a panel, the second connector being arranged behind that panel, is disclosed. The securing device includes at least two clips arranged on a front end to be directed towards the panel, at least one hollow starting from the front end and extending towards a rear end of the securing device, and at least one outward opening leading into it.

5 Claims, 5 Drawing Sheets

SECURING DEVICE FOR ELECTRICAL CONNECTORS AND APPLICATION THEREOF

BACKGROUND OF THE INVENTION

1. Field of the Invention

The present invention relates to a securing device for maintaining in contact electrical connectors, one of them being arranged behind a panel. It also relates to the connection of a power-supply unit and of an electrical apparatus.

For connecting an electrical apparatus such as a DSL modem (for "Digital Subscriber Line") to a power-supply, it is increasingly required that a power-supply cord be securely connected so as to avoid accidental disconnects.

2. Description of the Prior Art

The document U.S. Pat. No. 4,812,133 discloses a floating mount for an electrical connector assembly, which has a retaining clip snapped over a receptacle for securing on a panel. More precisely, a floating first electrical connector (receptacle) has contacts adapted to mate with complementary contacts carried by a: second electrical connector (plug) and has a limited floating movement within the plane of an opening in the panel. The retaining clip is snapped over the receptacle externally to the power supply. This arrangement requires special installations and mounting elements, resulting in additional costs and no possibility to exploit a common power-supply unit (hereinafter referred to as "PSU").

Also, the patent U.S. Pat. No. 5,228,865 discloses a float mount flanged type electrical connector, which has opposite coplanar flanges received between inner faces of straps. These straps mount the connector in a mounting panel cutout, and are secured to the rear face of the panel by means of bolts. Such a mounting arrangement involves tedious operations by the end users.

One could also provide for special clips on a PSU, to secure the PSU to a panel. However, this would involve special manufacturing, and thus additional costs and no possibility to exploit the existing PSU.

U.S. Pat. No. 5,525,074 describes a panel mounted connector, mountable in a removable way to an opening of a panel. The connector includes a male connector and a female connector mated with the latter, the female connector including a housing formed with an engagement hood position having an inner cavity engaged with the male connector and an outer periphery engaged with the mount opening of the panel. Again, like for document U.S. Pat. No. 4,812,133, specific installation and mounting elements are necessary.

Document U.S. Pat. No. 5,525,074 further discloses a panel arrangement in which of a mounted connector in which a connection fixture is used for mounting a connector plug into a panel mount hole. The connection fixture is formed with two opposing openings at both ends, and comprises a pair of lock arms with lock claws on its outer periphery. These lock arms are intended to be inserted into two respective through holes in the panel. However, such an arrangement may experience frequent failures, due to movements of the connector plug through the back-panel.

SUMMARY OF THE INVENTION

The present invention concerns a securing device for maintaining a first electrical connector in contact with a second electrical connector. The second electrical connector being intended to be arranged behind a panel placed between the securing device and the second electrical connector. The panel having at least one window for connecting the first and the second connectors through the window.

The securing device includes at least two clips arranged on a front end of the securing device. The front end being intended to be directed towards the panel. The clips are squeezed towards each other and inserted into the panel through the window and are then slackened so as to press against parts of the panel neighboring the window, thus maintaining the securing device fastened to the panel. When the clips are squeezed again towards each other and removed from the panel, they release the securing device.

There is also at least one hollow inside the securing device. The hollow starts from the front end of the securing device and extends towards a rear end of the securing device opposed to the front end. There is at least one outward opening leading into the hollow. The hollow is intended to receive the first electrical connector through the outward opening, so that the first connector is maintained in the securing device and can be connected to the second electrical connector through the outward opening at the front end of the securing device.

According to the invention, the hollow has a laterally decreasing size in the direction from the front end to the rear end of the securing device. This enables a user to position the first connector in the securing device by sliding the first connector inside the hollow, in the direction from the front end to the rear end of the securing device, and to remove the first connector from the securing device by sliding the first connector inside the hollow in the direction from the rear end to the front end of the securing device.

Thus, an intermediary device is used for securing the two connectors. The intermediary device is able to receive the first connector in its hollow and to be secured to the panel by means of the clips for providing the link to the second connector. The laterally decreasing size of the outward opening offers a very convenient way to fix the first connector while enabling it to receive several possible models and sizes of the first connector.

A significant advantage of this solution is that the first electrical connector is held safely in the securing device. Further, this can be true for various models of this first electrical connector, having different sizes and forms. Also, the securing device is user-friendly and convenient to install for end users.

The laterally decreasing size of the outward opening may be irregular, and may involve size jumps. For example, in one particular embodiment, the outward opening comprises at least two rectangular openings having sizes in descending order.

Preferably, the outward opening extends along the hollow from the front end towards the rear end of the securing device. This can make operations easier for the user. The term "towards the rear end", means that the rear end of the securing device is not necessarily reached by the hollow.

Advantageously, the outward opening may have a laterally decreasing size in the direction from the front end to the rear end of the securing device.

In another embodiment, two outward openings are provided, one at the front end and one at the rear end of the securing device. Those openings are designed for passing first into the hollow a thin and long part linked to the first connector, such as wiring, through both outward openings, and for introducing thereafter the first electrical connector in the hollow through the front-end outward opening, before maintaining it inside the securing device.

Complementary maintaining means can also be provided. In another embodiment in which the outward opening has two opposite sides along the hollow in the direction from the front end to the rear end of the securing device, a maintaining arm of the securing device is provided on one of the sides of the outward opening and able to be jammed on the opposite side of the outward opening.

In still another embodiment, the securing device contains a flexible material inside, forming the limits of the hollow, so flexible as to allow expansion of the outward opening under internal pressure. This enables one to force the first connector into the hollow, while the connector is maintained therein by pressure thereon, and to take it off by forcing it out of the hollow. Preferably, the securing device is flexible making it easier to move the clips closer together.

Also, in a more specific achievement, the clips are two, the first connector is a PSU connector, the securing device is flexible and its hollow is intended to receive the first connector by means of sliding there inside, and the panel is a back-panel of an electrical apparatus.

Then, in practice, an end user may take the first connector, which in a special embodiment may be a normal connector having standard dimension, and slide the securing device over it. The first connector thus fits into the securing device. The end user may further squeeze the ends of the securing device so that the two clips come closer to each other. In that way, the securing device is inserted into the back-panel. Once this is done, the PSU connector cannot be removed anymore unless the end user squeezes the ends of the securing device once again so that the clips come closer to each other again and the connector can be removed.

Advantageously, the securing device is made of plastic.

The invention also concerns a process for securing the securing device of any embodiment of the invention disclosed herein for connecting a power-supply unit including the first electrical connector, and an electrical apparatus having a rear face constituting the panel. The electrical apparatus includes the second electrical connector.

In one embodiment, the electrical apparatus is a modem, like an DSL modem. In another embodiment, the electrical apparatus is a set-top box or a radio receiver. The invention is more generally applicable to every apparatus having a power connector for which a secure connection is needed.

BRIEF DESCRIPTION OF THE DRAWINGS

The invention will be better understood and illustrated by means of the following embodiments, in which.

DETAILED DESCRIPTION OF PREFERRED EMBODIMENTS

Figure 1A:
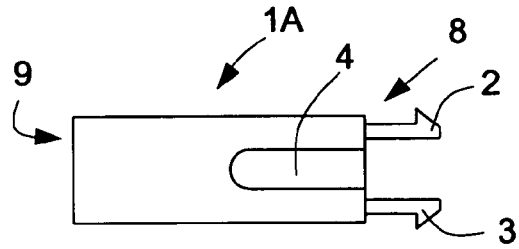
FIG. 1A is a upper view of a securing device according to a first embodiment of the invention.
Figure 1D:
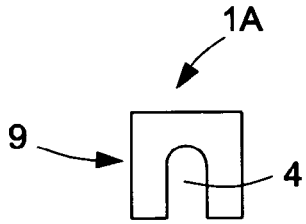
FIG. 1D is a rear view of the securing device of FIGS. 1A, 1B and 1C.
Figure 1B:
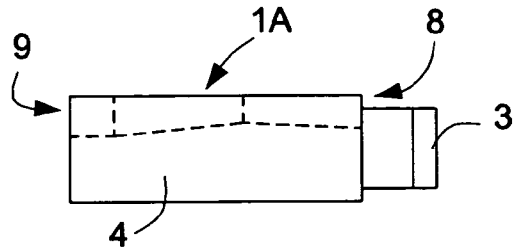
FIG. 1B is a side view of the securing device of FIG. 1A.
Figure 1C:
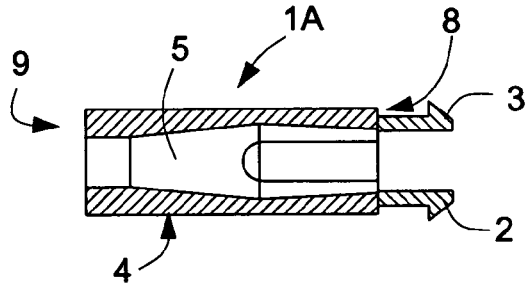
FIG. 1C is a lower view of the securing device of FIGS. 1A and 1B.
Figure 2:
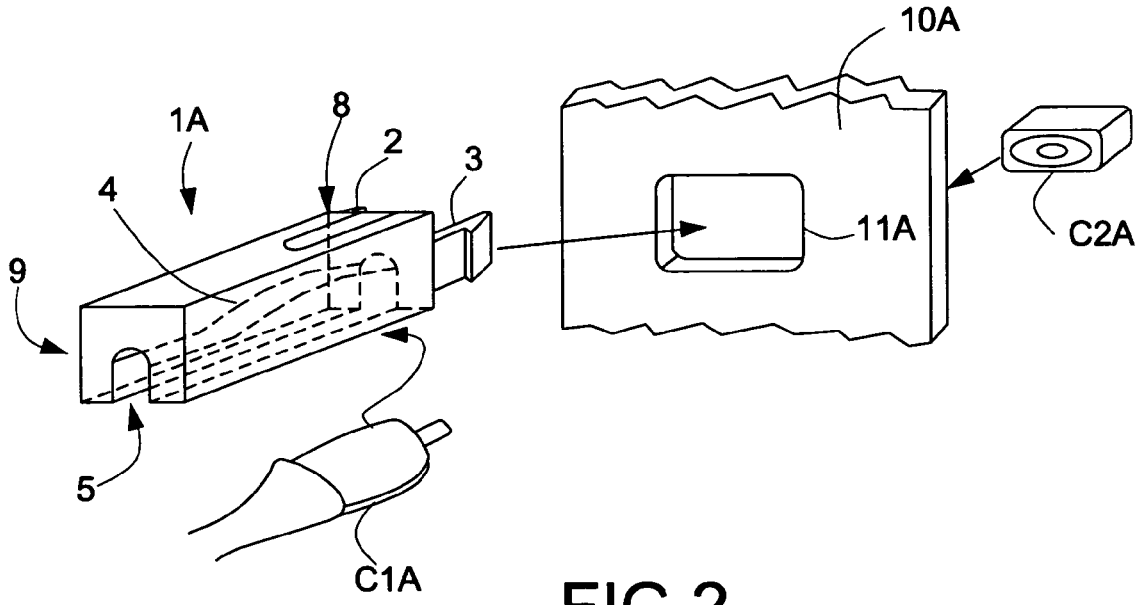
FIG. 2 is a view in perspective of the securing device of FIGS. 1A to 1D, showing also two connectors to be linked through a back-panel of an electrical apparatus, associated to the first embodiment.
Figure 3:
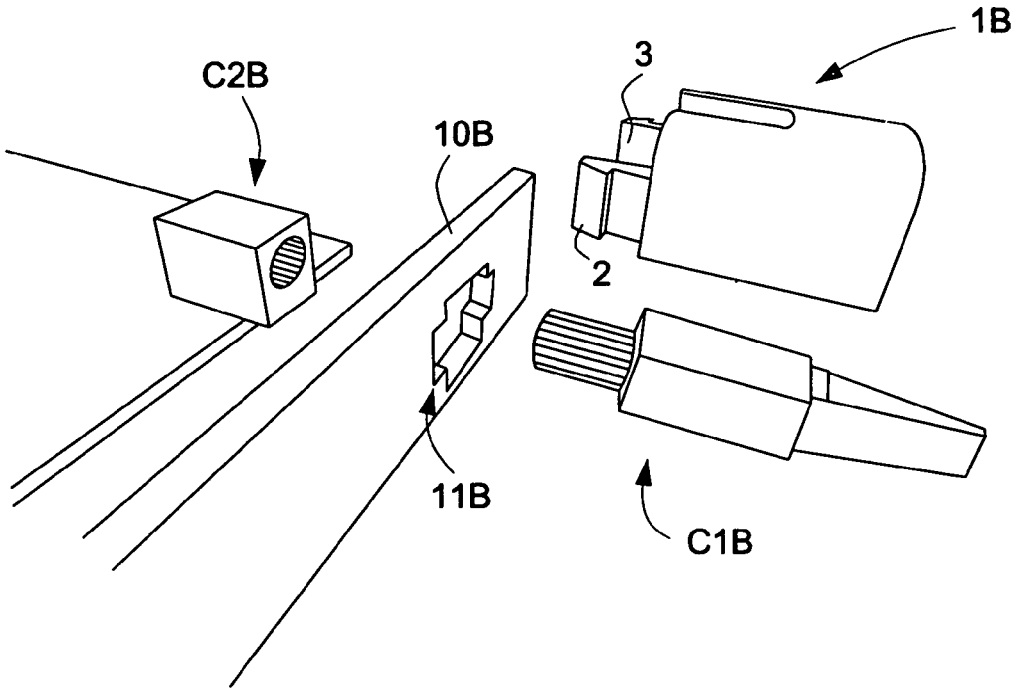
FIG. 3 is a view in perspective of a securing device according to a second embodiment of the invention, showing also two connectors to be linked through a back-panel of an electrical apparatus, associated to the second embodiment.
Figure 4:
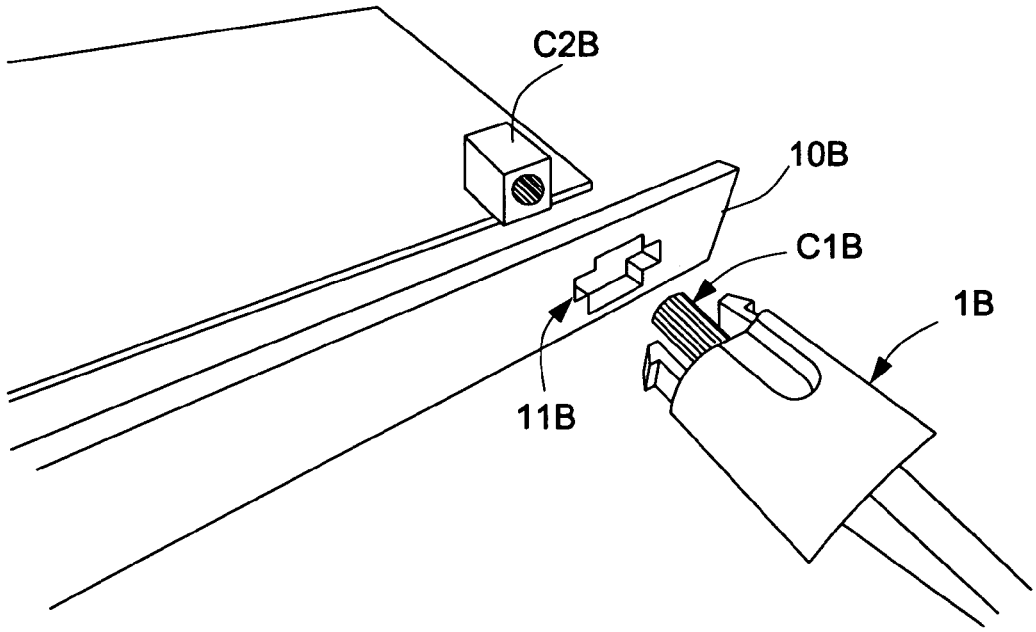
FIG. 4 shows the elements of FIG. 3 with one of the connectors in position within the securing device.
Figure 5:
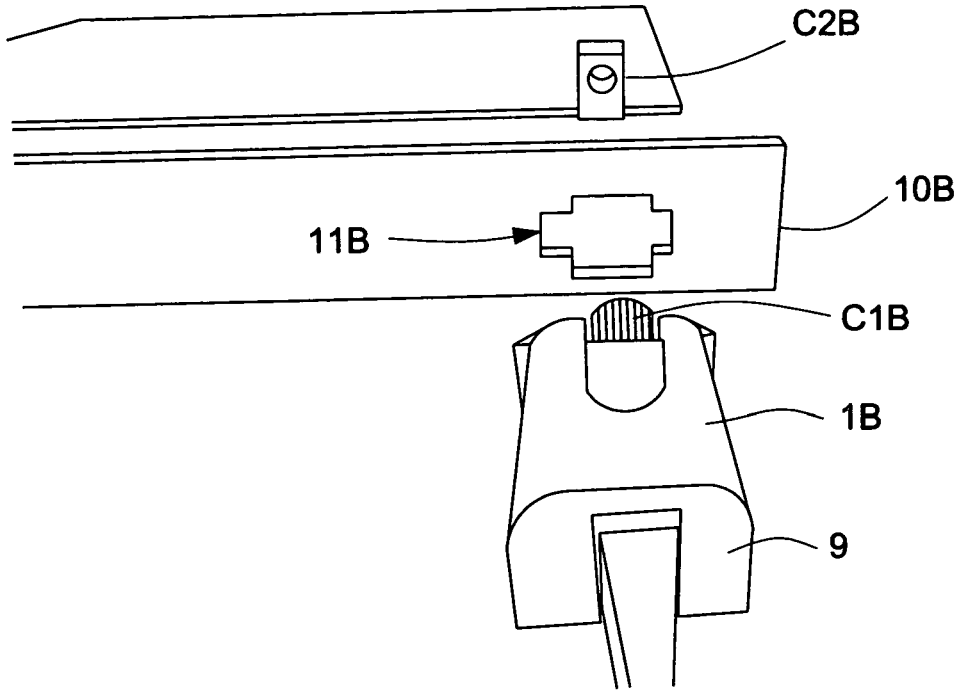
FIG. 5 represents a rear view of the elements of FIG. 4.
Figure 6:
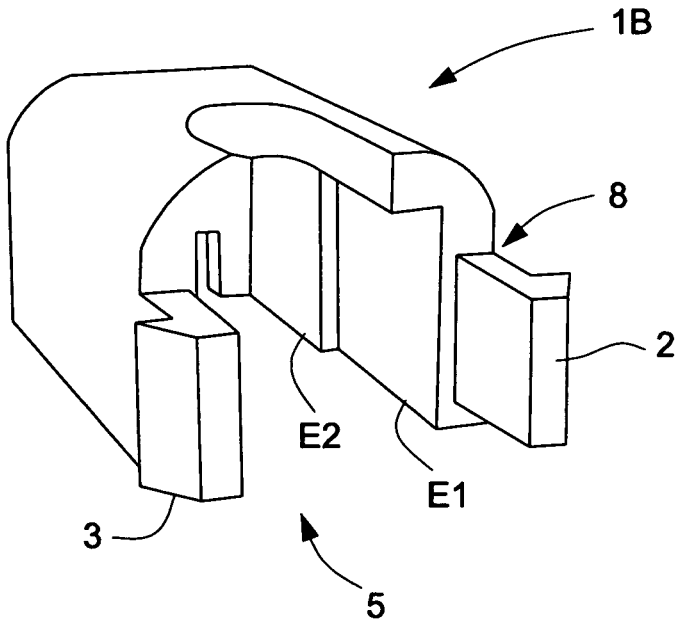
FIG. 6 is a front-side view of the securing device of FIGS. 3 to 5.
Figure 7:
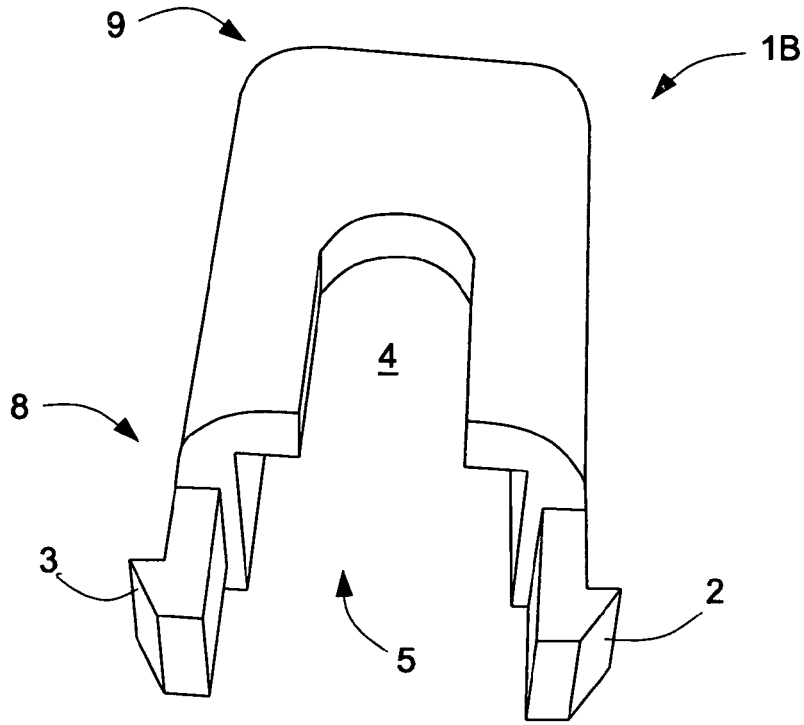
FIG. 7 is an upper-front view of the securing device of FIGS. 3 to 6.
Figure 8:
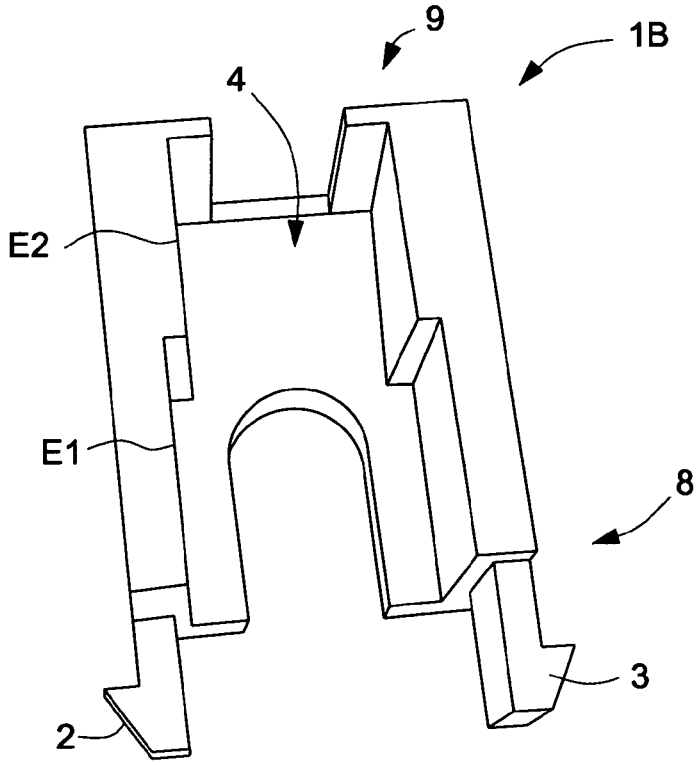
FIG. 8 is an upper-rear view of the securing device of FIGS. 3 to 7.

In the Figures, the references of the first and second embodiment may be completed with suffixes "A", "B" and "C" corresponding respectively to the first, second and third embodiments. The notation without those suffixes then relates to a generic designation of the concerned objects. Also, corresponding parts of the securing device in both embodiments may be noted with the same references.

A securing device 1 according to a first embodiment, noted 1A, (FIGS. 1A to 1D and 2) is intended to maintain a PSU connector C1 with an electrical connector C2 internal to an electrical apparatus (such as for example a DSL modem) having a back-panel 10 (notation 10A in that embodiment). The PSU connector C1, noted C1A, has a contact pin and the internal connector C2, noted C2A, is intended to receive that pin and to have it maintained inside. The two connectors C1A and C2A may be linked through a window 11 of the panel 10A, noted 11A in that embodiment and having a rectangular shape.

The securing device 1A is made of a flexible material, such as plastic. It comprises two clips 2, 3 arranged on a front end 8 thereof directed towards the panel 10A in operation. The clips 2, 3 may be squeezed towards each other, advantageously by squeezing the front end 8 of the securing device 1A.

Such a deformation makes it possible to insert the clips 2, 3 through the window 11A of the panel 10A, so as to secure device 1A fastened to the panel 10A, by pressing against the internal part of the panel 10A, at the vicinity of the window 11A. That deformation also enables one to squeeze the clips 2, 3 towards each other when the securing device 1A is fixed within the panel 10A, so as to release the securing device 1A.

The securing device 1A is further provided with a hollow 4 in its lower part and with an outward opening 5 leading into this hollow 4, which extend from the front end 8 to a rear end 9 of the securing device 1A by crossing the latter in its length. The hollow 4 and the outward opening 5 have a laterally decreasing width and a decreasing height, which may be irregular, from the front end 8 to the rear end 9.

The hollow 4 is able to receive the PSU connector C1A, which can be positioned in the securing device 1A by sliding inside the hollow 4 through the outward opening 5 from the front end 8 towards the rear end 9. In that way, the PSU connector C1A may be maintained in the securing device 1A and then connected to the internal connector C2A through a front part of the outward opening 5 (at the side of the front end 8) and through the opening 11A of the panel 10A.

In a second embodiment (FIGS. 3 to 8), the hollow 4 and the outward opening 5 of the securing device 1, noted 1B, differ essentially from the first embodiment in that they are laterally delimited by stepped edges E1 and E2 parallel with the longitudinal axis of the securing device 1B. Also, the back-panel 10, noted 10B has its window 11B with a cross shape (instead of a rectangle), through which the front part of the securing device 1, noted 1B, may be positioned.

Figure 9:
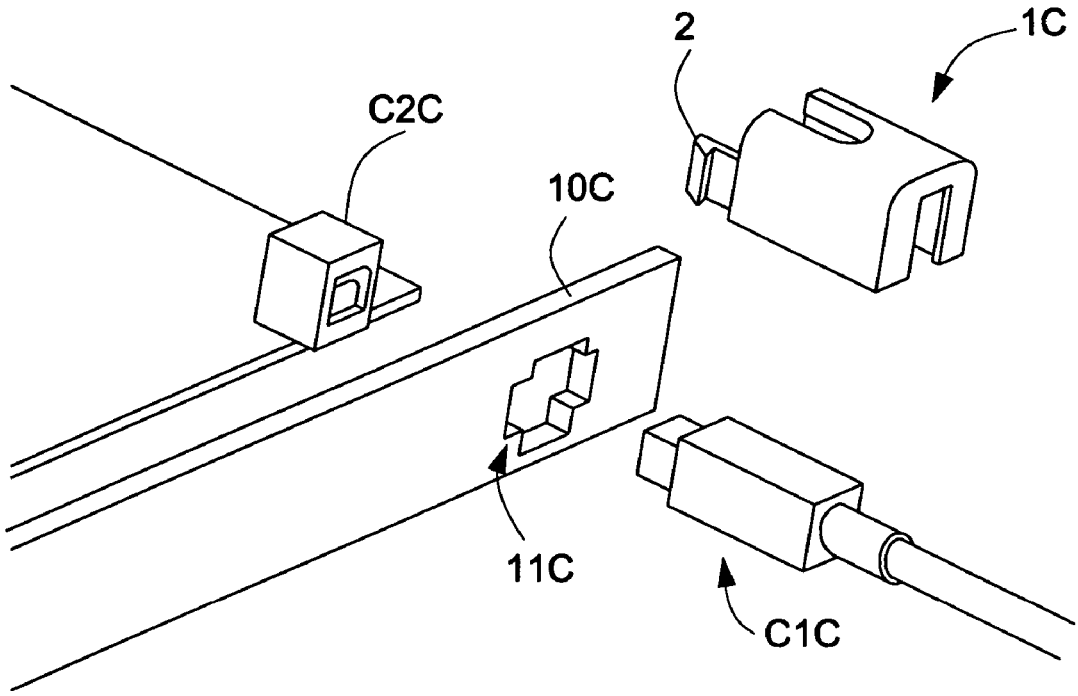
FIG. 9 is a view in perspective of a securing device according to a third embodiment of the invention, showing also two connectors to be linked through a back-panel of an electrical apparatus, associated to the third embodiment.

In a third embodiment (FIG. 9), the main differences with the second embodiment rely on the nature of the connectors C1 and C2, noted here C1C and C2C. Indeed; the electrical connectors C1C and C2C respectively consist in a plug USB-connector (for "Universal Serial Bus") and a corresponding internal USB connector, intended to be connected through the window 11, noted 11C, of the back-panel 10, noted 10C.

The invention claimed is:

1. A securing device for maintaining a first electrical connector in contact with a second electrical connector, the second electrical connector being intended to be arranged behind a panel placed between the securing device and the second electrical connector, the panel having at least one window for connecting the first and the second connectors through the window, the securing device comprising:

at least two clips arranged on a front end of the securing device, the front end being intended to be directed towards the panel, the clips being provided for being squeezed towards each other and inserted into the panel through the window and for being then slackened so as to press against parts of the panel neighboring the window, maintaining the securing device fastened to the panel, and for being squeezed again towards each other and removed from the panel to release the securing device;

at least one hollow inside the securing device, the hollow starting from the front end of the securing device and extending towards a rear end of the securing device opposed to the front end; and at least one outward opening leading into said hollow, the hollow being intended to receive the first electrical connector through the outward opening, so that the first connector remains within the securing device and can be connected to the second electrical connector through the outward opening at the front end of the securing device, wherein the hollow has a laterally decreasing size in the direction from the front end to the rear end of the securing device, enabling a user to position the first connector in the securing device by sliding the first connector inside the hollow, in the direction from the front end to the rear end of the securing device, and to remove the first connector from the securing device by sliding the first connector inside the hollow in the direction from the rear end to the front end of the securing device.

2. The securing device of claim 1 wherein the outward opening extends along the hollow from the front end towards the rear end of the securing device.

3. The securing device of claim 1 wherein the securing device is formed of plastic.

4. A method of securing the securing device of claim 1, comprising:

connecting a power-supply unit including the first electrical connector, and an electrical apparatus having a rear face constituting the panel, the electrical apparatus including the second electrical connector.

5. The method of claim 4 wherein the electrical apparatus is a modem.

* * * * *